US007267125B2

(12) United States Patent
Nevakshonoff

(10) Patent No.: US 7,267,125 B2
(45) Date of Patent: Sep. 11, 2007

(54) DEVICE FOR SANDING BUFFING OR GRINDING ELONGATE OBJECTS

(76) Inventor: Michael G. Nevakshonoff, 2609 - 10th Avenue, Castlegar, British Columbia (CA) V1N 3A4

( * ) Notice: Subject to any disclaimer, the term of this patent is extended or adjusted under 35 U.S.C. 154(b) by 0 days.

(21) Appl. No.: 11/511,233

(22) Filed: Aug. 29, 2006

(65) Prior Publication Data

US 2006/0289025 A1 Dec. 28, 2006

Related U.S. Application Data

(62) Division of application No. 11/030,051, filed on Jan. 7, 2005, now abandoned.

(51) Int. Cl.
*A45D 29/05* (2006.01)

(52) U.S. Cl. ..... 132/73.6; 132/76.4

(58) Field of Classification Search ..... 132/73.6, 132/73.5, 75.8, 75.6; 451/358, 49
See application file for complete search history.

(56) References Cited

U.S. PATENT DOCUMENTS 4,137,926 A * 2/1979 Pao ..... 132/73.6
4,255,826 A * 3/1981 Boyd ..... 15/21.1
4,301,567 A * 11/1981 Tucker ..... 15/160
4,478,232 A * 10/1984 Yasuda ..... 132/73.6
4,510,954 A * 4/1985 Miller ..... 132/75
5,123,430 A * 6/1992 Davidovitz ..... 132/75.8
5,339,477 A * 8/1994 Warner et al. ..... 15/97.1
5,379,474 A * 1/1995 Nakamura ..... 15/21.1
6,234,180 B1 * 5/2001 Davis et al. ..... 132/74.5
6,632,129 B2 * 10/2003 Goetz ..... 451/533
6,983,508 B2 * 1/2006 Saurer ..... 15/104.04

* cited by examiner

*Primary Examiner*—Todd E. Manahan
*Assistant Examiner*—Rachel A. Running
(74) *Attorney, Agent, or Firm*—Antony C. Edwards

(57) ABSTRACT

A device for sanding, buffing or grinding elongate objects includes a housing having a collar at one end and a rotatable sanding/buffing head rotatably mounted in the collar. The collar defines a cavity. A driveshaft is mounted to a motor in the housing for rotation of the driveshaft about an axis of rotation of the head upon actuation of the motor. A distal end of the driveshaft extends into the cavity in the collar. The sanding/buffing head may be cup-shaped and removably mounted or mountable into the collar on to the distal end of the driveshaft. The driveshaft rotates the cup within, and relative to, the collar upon the actuation of the motor. An abrasive is mounted to the annular inner surface of the cavity in the collar. The second end of the housing, opposite the first end, provides a handle for manual grasping and lifting by a user.

22 Claims, 7 Drawing Sheets

DEVICE FOR SANDING BUFFING OR GRINDING ELONGATE OBJECTS

CROSS REFERENCE TO RELATED APPLICATION

This application is a Divisional of U.S. application Ser. No. 11/030,051 filed Jan. 7, 2005, now abandoned, entitled Device for Sanding Buffing or Grinding Elongate Objects.

FIELD OF THE INVENTION

This invention relates to the field of devices for sanding, buffing or grinding generally, and in particular to an improved device for sanding, buffing or grinding elongate objects such as fingernails.

BACKGROUND OF THE INVENTION

Buffing, sanding and grinding devices are well known in the prior art. For example, it is known in the prior art to provide table-mounted grinding, sanding and buffing equipment wherein an abrasive mounted on a surface, such as on sandpaper, is rotationally translated on a disk or endless belt so as to abrade the surface of an object held against the abrasive.

In the particular instance of sanding and buffing fingernails, applicant is aware of the following patents: U.S. Pat. No. 2,424,509 which issued to Singer on Jul. 22, 1947 for a Rotary Finger Scrubbing Machine, U.S. Pat. No. 2,713,693 which issued to Johnson on Jul. 26, 1955 for a Finger-nail Polish Remover, U.S. Pat. No. 4,255,826 which issued to Boyd on Mar. 17, 1981 for a Nail Polish Remover, U.S. Pat. No. 4,478,232 which issued to Yasuda on Oct. 23, 1984 for a Nail Polisher, U.S. Pat. No. 4,800,606 which issued to Kolesky on Jan. 31, 1989 for a Digit Nail Cleaning Device, U.S. Pat. No. 5,007,441 which issued to Goldstein on Apr. 16, 1991 for an Electric Nail Polish Remover, U.S. Pat. No. 5,185,900 which issued to Warner et al. on Feb. 16, 1993 for an Apparatus for Removing Coatings from Fingernails, U.S. Pat. No. 5,339,477 which issued to Warner et al. on Aug. 23, 1994 for an Apparatus for Removing Coatings from Fingernails.

As may be seen, it is known in the prior art to provide table mounted devices similar to conventional grinding and sanding machines wherein an abrasive on a surface such as on sandpaper is rotated such that, when a fingernail is held against the rotating sandpaper, the surface of the fingernail is either abraded or polished depending on the coarseness, the so-called "grit", of the abrasive surface.

What is neither taught nor suggested, and which it is an object of the present invention to provide, is a portable, hand held sanding, buffing or grinding motorized apparatus which, when a user holds the apparatus in the user's hand, may be held sufficiently steadily so that a digit of the other hand or an object held in the other hand of the user may be inserted into a concavity or opening in a sanding, buffing or grinding cup mounted in cooperation with a selectively operable motor mounted in the apparatus housing. In applicant's opinion, the apparatus not only may be used for sanding, buffing or grinding, but may also provide for hardening of finger or toe nails and for the removal of ridges from same and the attendant advantages flowing therefrom.

SUMMARY OF THE INVENTION

In summary, the present invention may be characterized in one aspect as a device for sanding, buffing or grinding elongate objects, the device comprising a housing having a collar at one end and a rotatable sanding/buffing head rotatably mounted in the collar. The collar may be characterized as formed or mounted at a first end of the housing. The collar defines a cavity. A motor is mounted in the housing. A driveshaft is mounted to the motor for rotation of the driveshaft about an axis of rotation of the head upon actuation of the motor. A distal end of the driveshaft extends into the cavity in the collar. The sanding/buffing head may be cup-shaped and removably mounted or mountable into the collar on to the distal end of the driveshaft. The head is alternatively referred to herein as a cup. The driveshaft rotates the cup within, and relative to, the collar upon the actuation of the motor. The cup has an annular inner surface. An abrasive is mounted to the annular inner surface. The second end of the housing, opposite the first end, provides a handle for manual grasping and lifting by a user.

In one embodiment, wherein a rim of the collar defines an opening into the collar cavity and a rim of the cup defines an opening into the cup, the rim of the collar is substantially flush with the rim of the cup.

Advantageously, the cup is cylindrical and the axis of rotation is coaxial with an axis of symmetry of the cup so that a radial distance between the axis of rotation and the abrasive is substantially a constant about the axis of rotation. The cup may have an inner rear surface contiguous to the annular inner surface. The abrasive may also be mounted to the inner rear surface. Further advantageously, the cavity of the collar is cylindrical, and the cup nests or is nested snugly within the collar.

In one embodiment a demountable coupling is provided between the cup and the distal end of the driveshaft for manual demounting and remounting of the cup respectively from and to the driveshaft. In that embodiment at least one replacement cup may be provided for replacing the cup mounted in the collar. In such a set of replacement or replaceable cups, each cup has an abrasive having a different grit size so as to provide, by the plurality of cups, a range of the grit sizes or range of coarseness of the abrasive mounted in the collar. Thus in one embodiment adapted for use with fingernails, the grit sizes include a grinding grit size and buffing grit size, and radial distance or curvature of the head corresponds generally to a radius of curvature of a fingernail. In an alternative embodiment the cup may be lined around the annular inner surface of the cup with a resilient liner. The abrasive may be mounted to an innermost surface of the liner so as to sandwich the resilient liner between the cup and the abrasive.

A switch may be provided for selective actuation of the motor. The switch has an on-position for actuation of the motor. In one embodiment the on-position does not need to be manually maintained in the on-position in order that the motor, once actuated, remains actuated. The switch may be biased manually only once to engage the on-position and thereafter left with the motor running until manually biased into an off-position thereby dis-engaging and deactivating the motor. A battery may be mounted in the housing in electrical cooperation with the motor.

DETAILED DESCRIPTION OF EMBODIMENTS OF THE INVENTION

Figure 1:
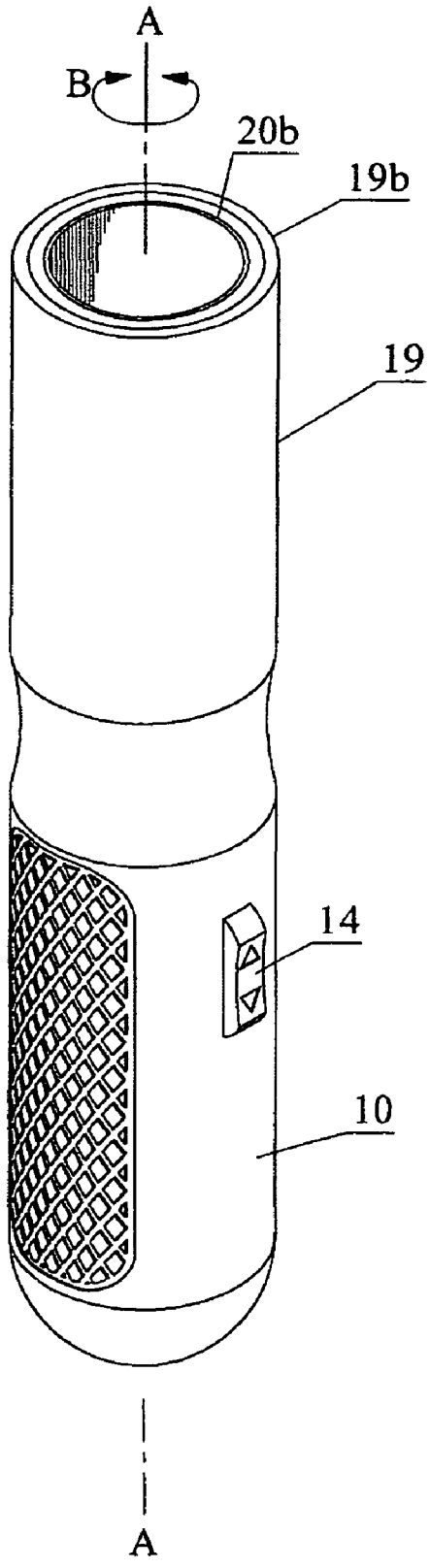
FIG. 1 is, in perspective view, one embodiment of the sanding, buffing or grinding device according to the present invention.
Figure 2:
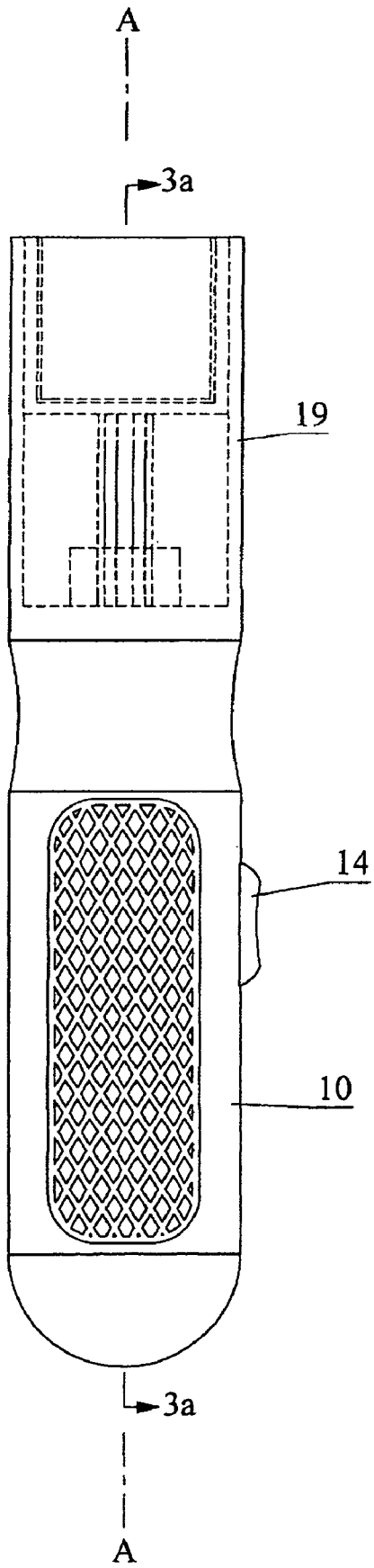
FIG. 2 is, in side elevation view, the device of FIG. 1.
Figure 3A:
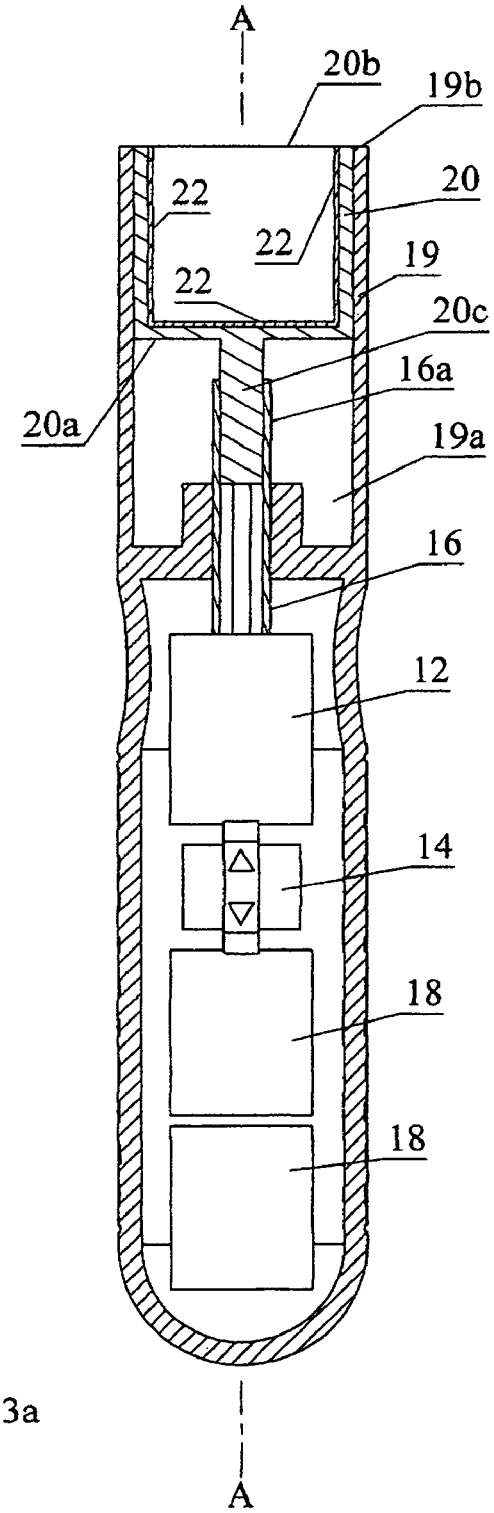
FIG. 3*a* is a sectional view along line 3*a*-3*a* in FIG. 2.
Figure 3B:
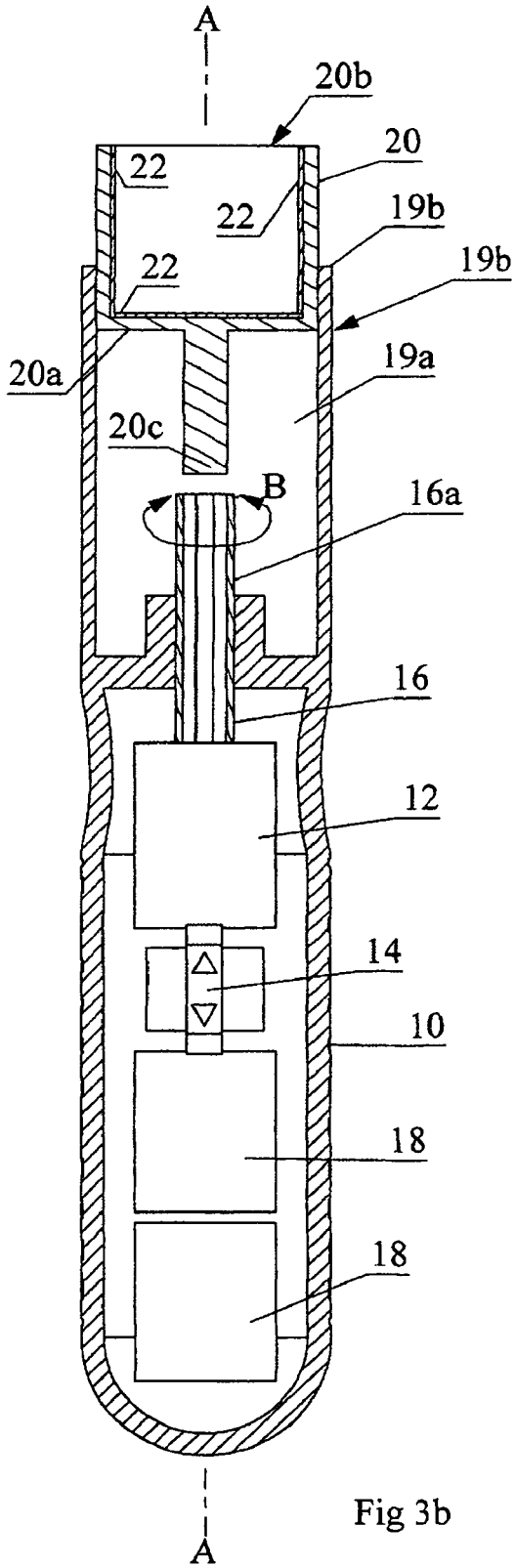
FIG. 3*b* is a view of FIG. 3*a* with the cup-shaped rotating head removed from the driveshaft.
Figure 4:
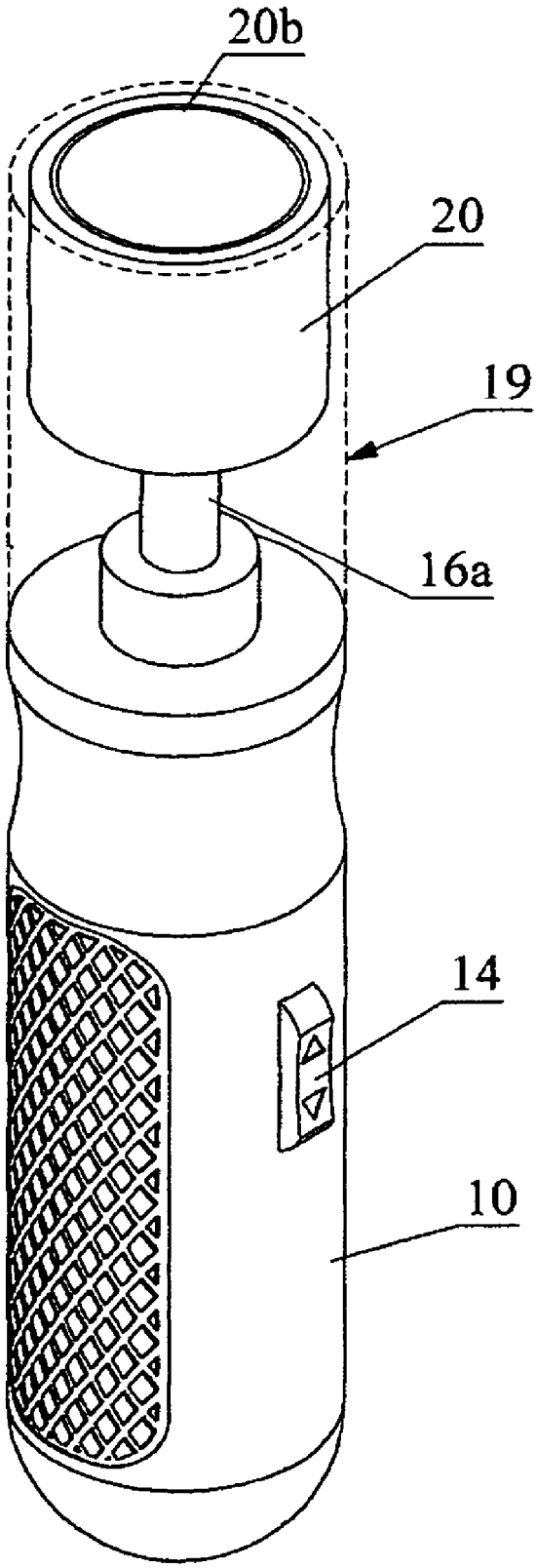
FIG. 4 is, in perspective view, the device of FIG. 1 with the non-rotating collar cut away and shown in dotted outline.
Figure 5:
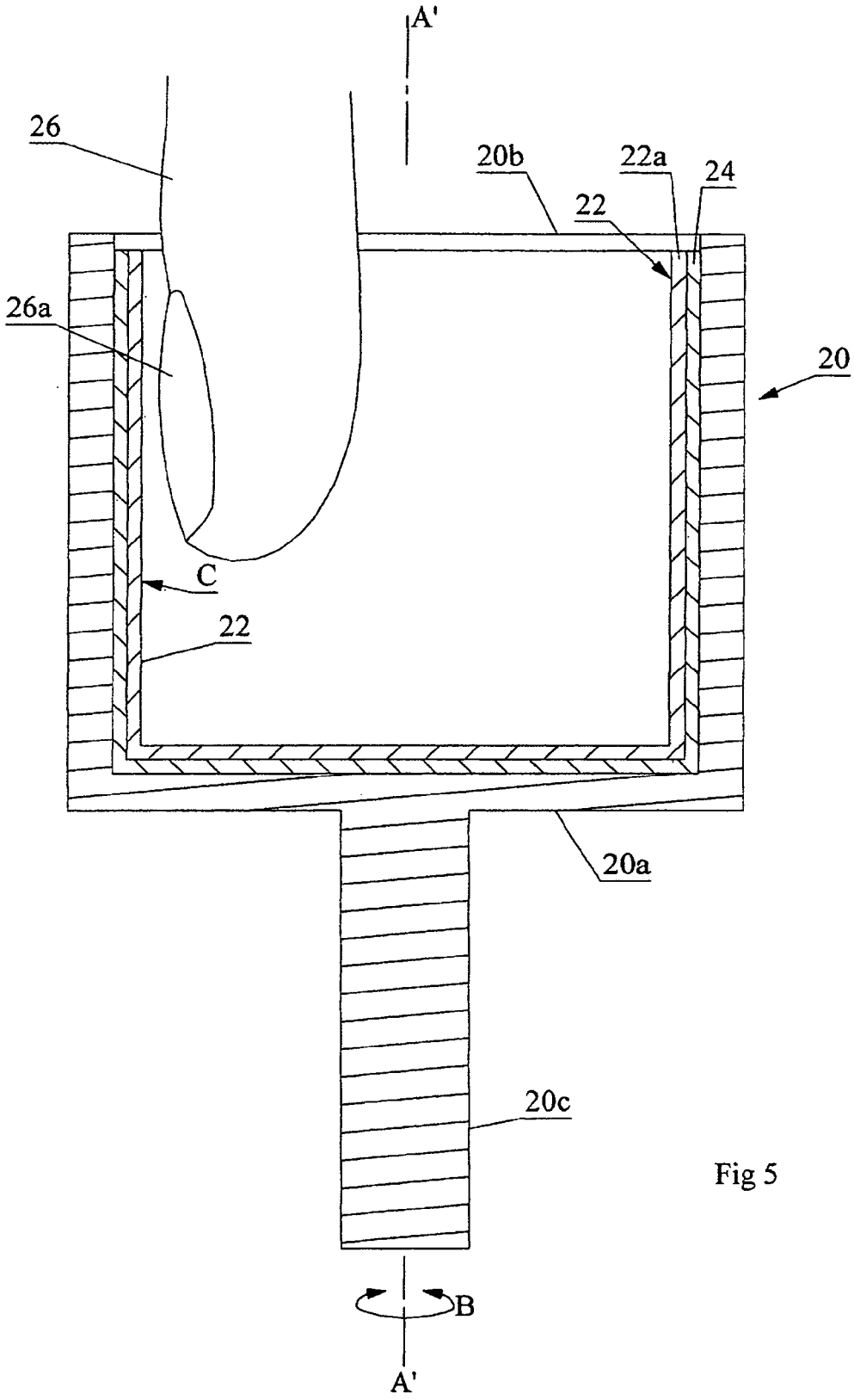
FIG. 5 is an alternative embodiment of the cup-shaped head of FIG. 3*a*.

As seen in the accompanying figures wherein corresponding reference numerals denote corresponding parts in each view, one embodiment of the sanding, buffing or grinding device according to the present invention includes a handle 10 containing an electric motor 12 selectively operable by a switch 14 so as to rotate a driveshaft 16 mounted to the motor so as to extend longitudinally from the handle along longitudinal axis A. Longitudinal axis A is the axis of rotation of the driveshaft as the driveshaft rotates in direction B relative to the handle. The motor may be battery powered or for example may be powered by way of an electrical connection to a direct current electric outlet within an automobile, or may be plugged into for example a residential alternating current electrical supply. In the illustrated embodiment, the motor is powered by a pair of batteries 18 which may include rechargeable batteries or conventional disposable batteries.

Advantageously, the switch, which may be toggled between electrically connecting the motor to the battery so as to operate the motor, and electrically disconnecting the motor from the battery so as to stop the motor's operation, includes a switch setting which allows the user to toggle the switch into the "on" position so as to engage the motor allowing the user to remove pressure from the switch while leaving the switch in the on-position, rather than having to hold pressure onto the on switch for it to remain in the on-position. Thus in operation, a user may simply toggle the switch into the on-position and the motor will then turn the driveshaft until the user applies pressure to the switch so as to toggle it to the "off" position, but in the meantime the user does not have to remain in contact with the switch. In an alternative embodiment, a timer, rotation counter or the like and a processor (not shown) is provided within the housing so that the direction of rotation of the driveshaft is automatically reversed at preset intervals, for example every ten revolutions, while the motor is activated.

In the preferred embodiment, the driveshaft extends into a cylindrical cavity 19*a* formed by a rigid tube or sleeve or collar (collectively referred to herein as a collar 19) extending rigidly from one end of the handle. In the embodiment illustrated, the cylindrical cavity 19*a* is coaxial with the axis of rotation A of the driveshaft so that the driveshaft is centered along the long axis of collar 19.

Replaceable cup-shaped sanding, buffing or grinding heads 20 may be inserted by the user into collar 19 so as to engage a stub shaft 20*c* extending from the closed rearward end 20*a* of the head into releasable locking engagement with the female end 16*a* of the driveshaft so as to substantially fully concentrically nest the head 20 completely within the collar 19 when the stub shaft is mated with the female end of the driveshaft. Thus, when so mated, the rim 20*b* of the open end of the head 20 is, in the illustrated embodiment, flush with the rim 19*b* of the open end of the collar 19. An abrasive 22 mounted on a substrate surface, such as that provided by sandpaper or by buffing paper (such as conventional wet-or-dry buffing paper sold commercially) is mounted into the head so as to line the interior surface of the head. For example, the abrasive 22 may be provided by gluing or otherwise fastening sandpaper 22*a* or the like around the interior cylindrical inner surface of head 20 and also on the inner surface of the closed end 20*a* of the head.

In an alternative embodiment, the abrasive 22 may be mounted onto a resilient backing 24 or onto resilient fasteners such as double-sided thin foam tape or sheet. Thus an object such as a fingernail 26*a* pressed in direction C against the abrasive surface may resiliently deform the abrasive surface by resiliently compressing the resilient layer sandwiched between the abrasive surface and the inner surface of the head. Abrasive 22 thus abrades or buffs fingernail 26 as head 20 rotates in direction B about the axis of rotation A'.

Thus for example if a user wishes to use the device according to the present invention to buff his or her fingernails, a sanding or buffing head is selected which a fine rather than coarse abrasive surface, for example 600 grit, and that head is mounted onto the driveshaft by sliding the head into the collar until the openings of the head and collar are flush. The stub shaft is thereby fully mated into the female end of the driveshaft. The user, with the hand grasping the handle, toggles the switch to the on position causing the head to rotate in direction B within the collar. A finger 26 from the other hand of the user may then be inserted into the cavity defined by the collar and the fingernail 26*a* pressed against abrasive 22 as the abrasive surface is rotating in direction B about axis of rotation A. The handle may then be manipulated or the fingernail moved so as to cause relative displacement between the fingernail and the rotating head so as to bring the rotating abrasive surface into contact with all of the fingernail surface requiring buffing or abrading.

In a useful embodiment useful for buffing fingernails, the head may have an inside diameter of approximately one inches (2.2 centimetres) so that the curvature of the inside of the collar and head conforms somewhat to the curvature of an average fingernail.

Figure 6:
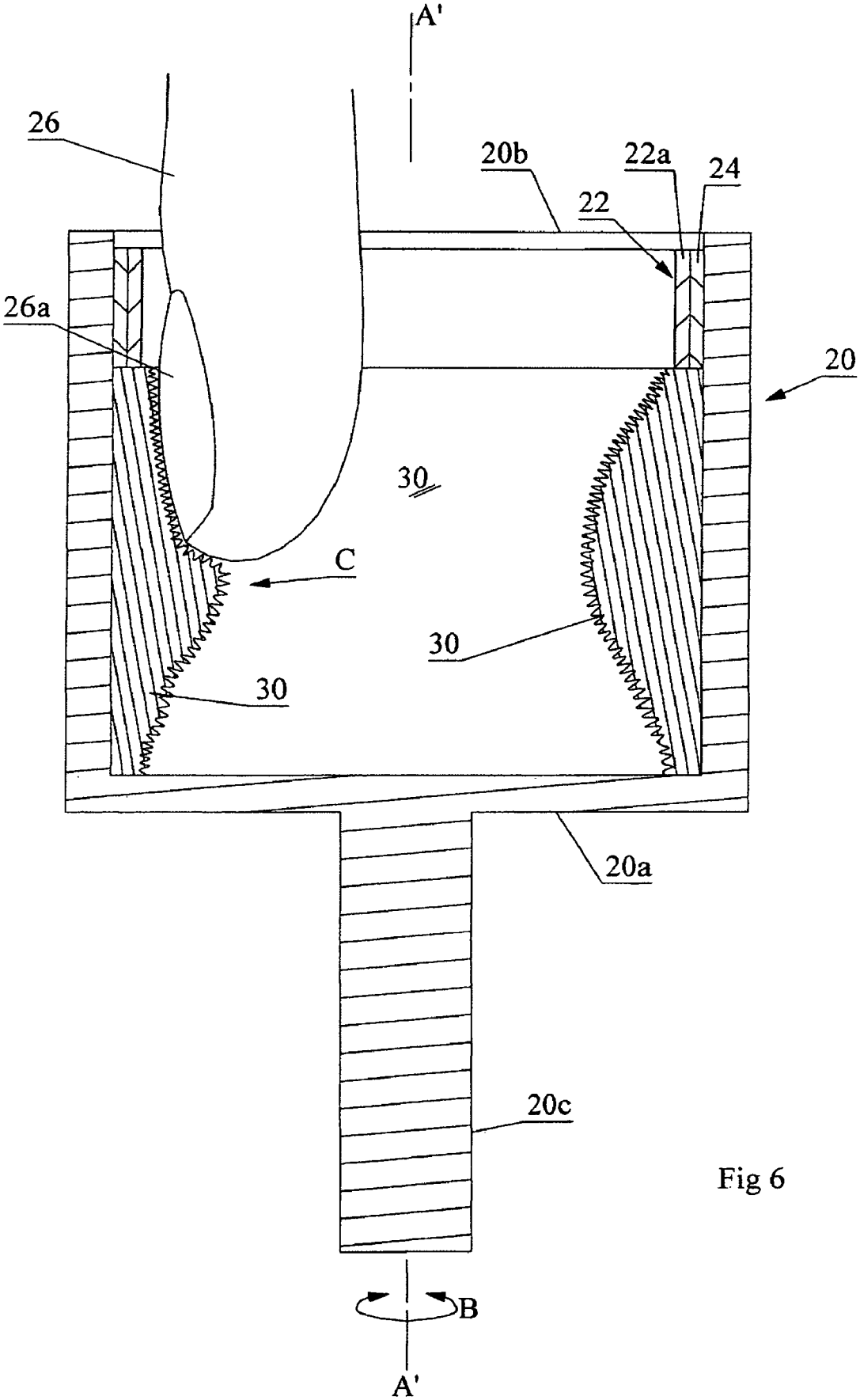
FIG. 6 is the view of FIG. 5 showing an alternative embodiment of a buffing/polishing head illustrating the use of a soft buffing liner for nail maintenance.
Figure 7:
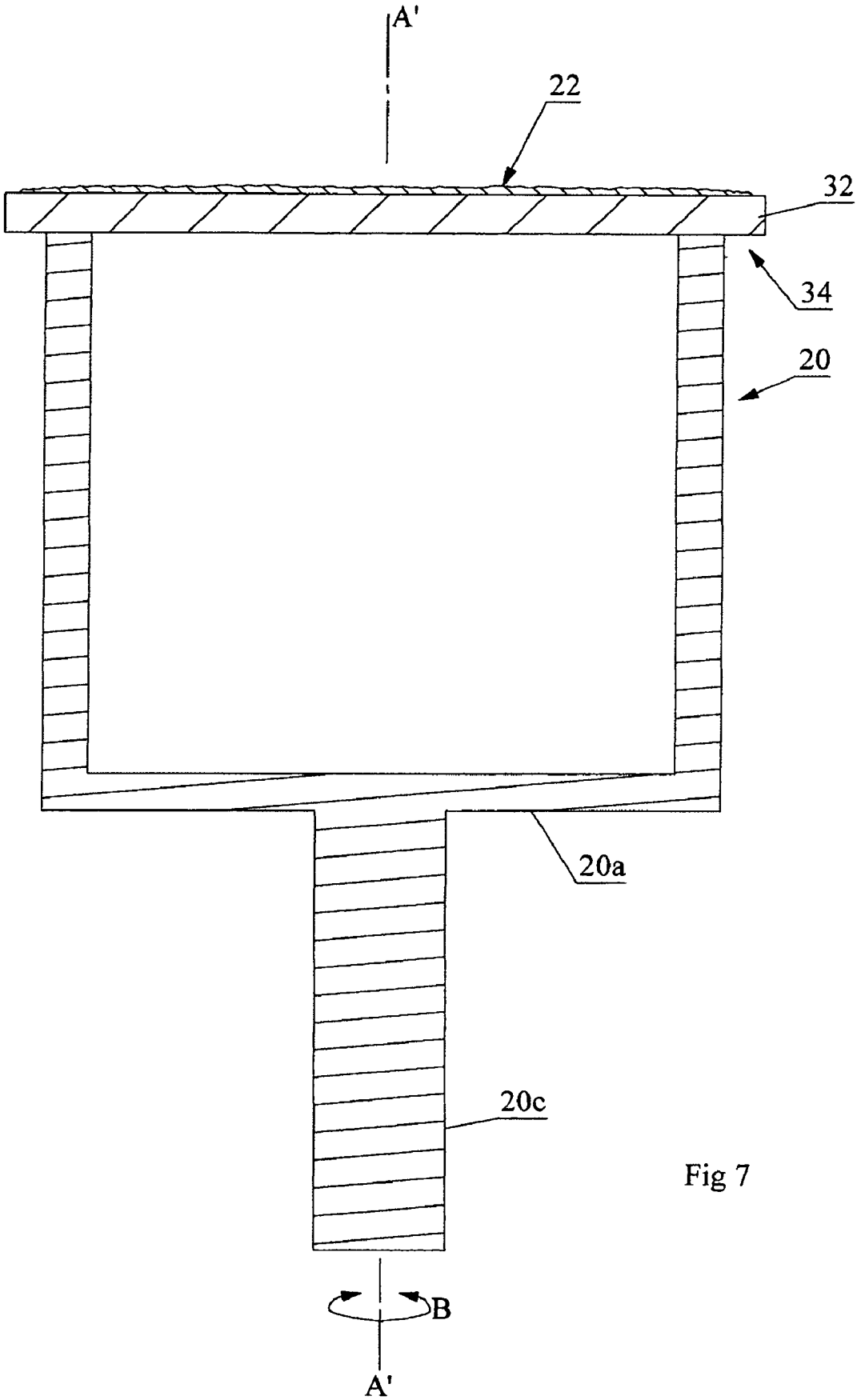
FIG. 7 is a sectional view of a further alternative flat drum head.

In an alternative embodiment, as seen in FIG. 6, the inside of the cup may be lined with a buffing polishing liner such as, for example, the chamois or lambs wool liner 30 illustrated. This may be employed for weekly maintenance of the nail. In one embodiment not intended to be limiting, lining 30 is mounted within head 20 so as to leave an abrasive band adjacent the opening into head 20, for example an abrasive band which extends one quarter inch into the head.

In a further alternative embodiment, a flat rigid disc 32 is mounted across the open end of head 20'. Abrasive 22 is mounted to the exterior face of the disc to provide a flat rotating abrasive surface perpendicular to the axis of rotation A' of head 20'. Such a head may be used for the front edges of fingernails, for removing excess skin from the balls of the feet, etc. Disc 32 has a diameter wider than the diameter of head 20' to provide an overlap 34 protruding beyond head 20. The overlap provides for ease of grasping of the disc so as to ease removal of head 20' from within the collar when it is desired to change to a different head.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for sanding, buffing or grinding elongate objects, the device comprising:

a housing having opposite first and second ends, said first end of said housing including a collar defining a cavity a motor mounted in said housing a driveshaft mounted to said motor for rotation of said driveshaft about an axis of rotation upon actuation of said motor, a distal end of said driveshaft and said axis of rotation extending into said cavity, a cup mounted into said collar and onto said distal end of said driveshaft for rotation of said cup within, and relative to, said collar upon said actuation of said motor, wherein said cup has an annular inner surface and an abrasive for sanding, buffing or grinding is mounted to said inner surface, and wherein said cup has an inner rear surface contiguous to said annular inner surface, and wherein said inner rear surface is substantially continuously planar across all of said inner rear surface and said driveshaft does not protrude into said cup so that a finger-tip receiving space in said cup is unobstructed, and wherein said second end of said housing provides a handle for manual grasping and lifting by one hand of a user of said housing by said user using only the one hand of the user, wherein said cup is lined around said annular inner surface with a resilient liner and said abrasive is mounted to an innermost surface of said liner so as to sandwich said resilient liner between said cup and said abrasive.

2. The device of claim 1 wherein a rim of said collar defines an opening into said cavity and a rim of said cup defines an opening into said cup, and wherein said rim of said collar is substantially flush with said rim of said cup.

3. The device of claim 1 wherein said cup is cylindrical and wherein said axis of rotation is coaxial with an axis of symmetry of said cup so that a radial distance between said axis of rotation and said abrasive is substantially a constant about said axis of rotation.

4. The device of claim 3 further comprising a switch for selective actuation of said motor, wherein said switch has an on-position for actuation of said motor and wherein said switch, when in said on-position does not need to be manually maintained in said on-position in order that said motor, once actuated, remains actuated, whereby said switch may be biased manually only once to engage said on-position and thereafter left with said motor running until manually biased into an off-position thereby dis-engaging and deactivating said motor.

5. The device of claim 3 further comprising a battery mounted in said housing in electrical cooperation with said motor.

6. The device of claim 3 wherein said cavity of said collar is cylindrical, and said cup is nested snugly within said collar.

7. The device of claim 6 wherein said inner rear surface has said abrasive mounted thereto.

8. The device of claim 6 further comprising a demountable coupling between said cup and said distal end of said driveshaft for manual demounting and remounting of said cup respectively from and to said driveshaft.

9. The device of claim 8 further comprising at least one replacement cup for replacing said cup, wherein each cup of said at least one replacement cup has an abrasive having a different grit size so as to provide a plurality of said cups thereby providing a range of said grit sizes.

10. The device of claim 9 wherein said grit sizes include a grinding grit size and buffing grit size.

11. The device of claim 10 wherein said radial distance corresponds generally to a radius of curvature of a fingernail.

12. A device for buffing elongate objects comprising:

a housing having opposite first and second ends, said first end of said housing including a collar defining a cavity a motor mountable in said housing a driveshaft mountable to said motor for rotation of said driveshaft about an axis of rotation upon actuation of said motor, a distal end of said driveshaft and said axis of rotation extending into said cavity, a cup mountable into said collar and onto said distal end of said driveshaft for rotation of said cup within, and relative to, said collar upon said actuation of said motor, wherein said cup has an annular inner surface and an abrasive for sanding, buffing or grinding is mountable to said inner surface, and wherein said cup has an inner rear surface contiguous to said annular inner surface, and wherein said inner rear surface is substantially continuously planar across all of said inner rear surface and said driveshaft does not protrude into said cup so that a finger-tip receiving space in said cup is unobstructed, and wherein said second end of said housing provides a handle including a handgrip adapted for manual grasping and lifting by one hand of a user of said housing by said user using only the one hand of the user, wherein said cup is lined around said annular inner surface with a resilient liner and said abrasive is mountable to an innermost surface of said liner so as to sandwich said resilient liner between said cup and said abrasive.

13. The device of claim 12 wherein a rim of said collar defines an opening into said cylindrical cavity and a rim of said cup defines an opening into said cup, and wherein said rim of said collar is substantially flush with said rim of said cup.

14. The device of claim 12 wherein said cup is cylindrical and wherein said axis of rotation is coaxial with an axis of symmetry of said cup so that a radial distance between said axis of rotation and said abrasive is substantially a constant about said axis of rotation.

15. The device of claim 14 further comprising a battery mountable in said housing in electrical cooperation with said motor.

16. The device of claim 14 further comprising a switch for selective actuation of said motor, wherein said switch has an on-position for actuation of said motor and wherein said switch, when in said on-position does not need to be manually maintained in said on-position in order that said motor, once actuated, remains actuated, whereby said switch may be biased manually only once to engage said on-position and thereafter left with said motor running until manually biased into an off-position thereby dis-engaging and deactivating said motor.

17. The device of claim 14 wherein said cavity of said collar is cylindrical, and said cup is nested snugly within said collar.

18. The device of claim 17 wherein said inner rear surface has said abrasive mountable thereto.

19. The device of claim 17 further comprising a demountable coupling between said cup and said distal end of said driveshaft for manual demounting and remounting of said cup respectively from and to said driveshaft.

20. The device of claim 19 further comprising at least one replacement cup for replacing said cup, wherein each cup of said at least one replacement cup has an abrasive having a different grit size so as to provide a plurality of said cups thereby providing a range of said grit sizes.

21. The device of claim 20 wherein said grit sizes include a grinding grit size and buffing grit size.

22. The device of claim 21 wherein said radial distance corresponds generally to a radius of curvature of a fingernail.

* * * * *